US005133885A

United States Patent [19]

Contor et al.

[11] Patent Number: 5,133,885

[45] Date of Patent: Jul. 28, 1992

[54] NEW SOFTENING COMPOSITIONS AND METHODS FOR MAKING AND USING SAME

[75] Inventors: Laura Contor, Liege; Yves Lambremont, Grivegnee; Claude Courard, Fexhe-Slins; Purificacion Rivas, Ans, all of Belgium

[73] Assignee: Colgate-Palmolive Company, Piscataway, N.J.

[21] Appl. No.: 734,125

[22] Filed: Jul. 25, 1991

Related U.S. Application Data

[63] Continuation of Ser. No. 422,352, Oct. 16, 1989, abandoned.

[51] Int. Cl.[5] ..... D06M 10/08

[52] U.S. Cl. ..... 252/8.6; 252/8.7; 252/8.75; 252/8.8; 252/8.9

[58] Field of Search ..... 252/8.6, 8.7, 8.75, 252/6.8 R, 8.9

[56] References Cited

U.S. PATENT DOCUMENTS

| | | | |
|---|---|---|---|
| 3,038,820 | 6/1962 | Albrecht | 117/139.5 |
| 3,933,871 | 1/1976 | Armstrong | 252/8.8 |
| 4,077,891 | 3/1978 | Beimesch et al. | 252/8.6 |
| 4,092,253 | 5/1978 | Cuntze | 252/8.8 |
| 4,129,506 | 12/1978 | Wallhauser | 252/8.8 |
| 4,134,840 | 1/1979 | Minegishi et al. | 252/8.6 |
| 4,136,054 | 1/1979 | Petzold et al. | 252/8.8 |
| 4,237,016 | 12/1980 | Rudkin et al. | 252/8.8 |
| 4,370,272 | 1/1983 | Wechsler et al. | 252/8.6 |
| 4,370,273 | 1/1983 | Kinsman et al. | 252/8.8 |
| 4,399,044 | 8/1983 | Richmond | 252/8.8 |
| 4,424,134 | 1/1984 | Sissin et al. | 252/8.8 |
| 4,486,195 | 12/1984 | Weinstein et al. | 252/8.8 |
| 4,589,989 | 5/1986 | Müller et al. | 252/8.75 |
| 4,661,269 | 4/1987 | Trinh et al. | 252/8.75 |
| 4,724,089 | 2/1988 | König et al. | 252/8.8 |
| 4,762,645 | 8/1988 | Tucker et al. | 252/8.6 |
| 4,786,439 | 11/1988 | Ploog et al. | 252/8.8 |
| 4,840,738 | 6/1989 | Hardy et al. | 252/8.6 |
| 4,842,760 | 6/1989 | Tsumadori et al. | 252/8.8 |
| 4,855,072 | 8/1989 | Trinh et al. | 252/8.8 |
| 4,880,430 | 11/1989 | Schleusener | 252/8.8 |
| 4,931,216 | 6/1990 | Igarashi et al. | 252/8.8 |
| 4,975,091 | 12/1990 | Becker et al. | 252/8.8 |

*Primary Examiner*—A. Lionel Clingman
*Assistant Examiner*—William S. Parks
*Attorney, Agent, or Firm*—Bernard Leiberman; Murray M. Grill; Robert C. Sullivan

[57] ABSTRACT

Environmentally safe, stable, pourable aqueous fabric softening compositions based on the combination of a quaternary ammonium compound and an amido amine. The softener combination comprises from as little as 1% and up to 60% and preferably 2 to 20% by weight of the composition. Methods for making the composition are also described. Softening performance is outstanding and the compositions are simple to prepare, even the more highly concentrated forms. The softener compositions are primarily intended for use in the rinse cycle of an automatic washing machine.

7 Claims, No Drawings

NEW SOFTENING COMPOSITIONS AND METHODS FOR MAKING AND USING SAME

This application is a continuation of application Ser. No. 07/422,352, filed Oct. 16, 1989, now abandoned.

The invention relates to fabric softening compositions adapted to be used in the rinse cycle of an automatic fabric washing machine. More particularly, this invention is concerned with aqueous fabric softening compositions which impart improved softness and other desirable attributes such as stability, (in viscosity as well as in phase separation). Specifically, the invention is based on the combination of a quaternary ammonium softener and a unique higher fatty class of amido amines.

Compositions containing quaternary ammonium salts having at least one long chain hydrocarboxyl group such as distearyl dimethyl ammonium chloride or long-chain imidazolinium salts are commonly used to provide fabric softening benefits when employed in a laundry rinse operation; for example, see U.S. Pat. Nos. 3,349,033; 3,644,203; 3,946,115; 3,997,453; 4,073,735; and 4,119,545, among many others.

The quaternary ammonium compounds, while they are salts, are nevertheless generally characterized as water-insoluble since their solubility in water under normal conditions is less than about 5% by weight. The usual concentration used by the consumer and accepted as the "standard" is 6% by weight. At this and higher concentrations these cationic salts are generally present as "sols" or dispersions, and stability becomes a major problem. See, for example, U.S. Pat. No. 4,426,299 col. 1, lines 11 to 22. As a matter of fact, stability and viscosity problems become major ones at higher concentrations, e.g., above about 7% by weight of the cationic. There have been many proclaimed solutions for providing concentrated (i.e. 6–7%) stable cationic formulations within usable and consumer acceptable viscosity ranges, e.g., 30 cps. to 500 cps. See, for example, U.S. Pat. Nos. 4,442,013 and 4,661,270. While such concentrated formulations may afford stable and acceptable viscosity products, their softening characteristics, of course, at equivalent concentrations, are essentially the same as the 6–7% products.

It is desirable to provide cationic softening compositions, particularly for use in the rinse cycle of a clothes washing machine, which are of improved softening not only at equal concentrations with older formulations, but even at lower concentrations. This concept is not new as evidenced, e.g., by U.S. Pat. No. 4,000,077 to Wixon wherein cationic quaternary softener is combined with alcohol or alcohol ether sulfate. This patent also demonstrates that with improved softening, another plus is achieved in terms of enhanced whiteness, the latter often being adversely affected by cationics. Another patent in this category is U.S. Pat. No. 4,772,403 to Grandmaire and Jacques wherein specific combinations of cationic softener and fatty alcohol give superior physical characteristics as well as enhanced softening benefits.

While there are literally thousands of patents describing quaternary ammonium compounds and combinations of same as laundry, rinse cycle fabric softeners and others of amines for similar uses, mention should be made of European Patent Application 0199383 which discloses certain acylated polyamines, and acylated quaternized polyamines; U.S. Pat. No. 4,399,045 which describes a quaternized bis-acylated diethylene triamine containing from 1 to 5 hydroxyethyl; U.S. Pat. No. 4,399,044; U.K. Application 2032479A published May 8, 1980 which describes amide amines of the formula $$RNH[(CH_2)_nNR]_mR$$

wherein an average of 20% to 80% of the R groups per molecule are acyl groups having an average of from 12 to 22 carbon atoms and at least 20% of the R groups are $—CH_2CH_2OH$ or $—CH_2CH(OH)CH_3$, n is 2 or 3; m is 2 to 5; the compounds are used as textile softeners for laundered goods; French 2273907 describes diacylamide amines as fabric softeners.

None of foregoing prior art teaches, discloses, or in any way suggests the combination which is the basis for this invention.

It has now been discovered that improved softening compositions are provided by a combination of a cationic quaternary softener or mixture of cationic softeners with an ethoxylated bis-fatty acid amido amine.

The cationics which are useful herein include a specific class of fatty ester quaternary ammonium compounds (ester quat) which may be represented by the following general formula.

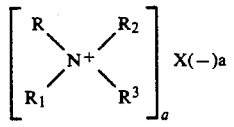

I wherein at least one of the R groups and preferably two (e.g., R. & $R_1$) represents an aliphatic ester residue of from 12 to 30 carbon atoms of the structure

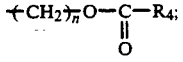

n=1 to 3 and the other R groups (e.g., $R_2$ & $R_3$) may be lower aliphatic, e.g., from $C_1$ to $C_8$ preferably $C_1$ to $C_4$ and preferably, alkyl or aralkyl as methyl, ethyl and propyl or benzyl; or hydroxyalkyl (i.e. $—CH_2CH_2O)pH$ & p=1 to 5;

$X^-$ is any anion, e.g., halo, sulfate, methosulfate, nitrate, acetate, phosphate, benzoate, oleate, etc. The symbol "a" represents the ionic valance of the anion and, also, therefore, the number of quaternary cationic moieties in association therewith. Thusly, with a sulfate anion we would have

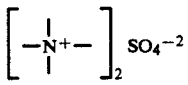

Specific preferred compounds include:

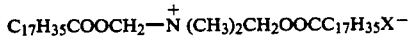

(1)

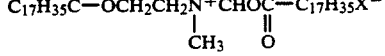

(2)

-continued

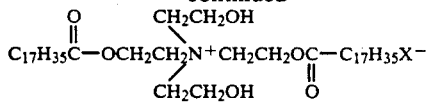

(3)

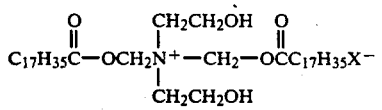

(4)

Other useful compounds are the monoesters as well as polyethoxylates of both the mono and diester type.

The bis-acylamido amines have the general formula:

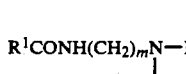

$R^1 = C_{12}$ to $C_{30}$ alkyl or alkenyl preferably $C_{16}$ to $C_{18}$;
$R^2 = R^1CONH(CH_2)m$ or $R^1$ or $CH_2CH_2OH$;
$R^3 = -(CH_2CH_2O)_pH$ or $-H$ and wherein
m = 1 to 5
p = 1 to 5

Preferred amido amines include

Compound #1:

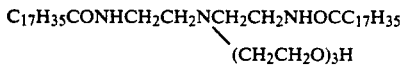

Compound #2:

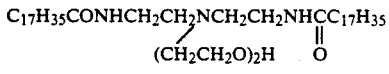

Compound #3:

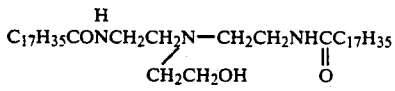

EXAMPLE I

A softening composition of the following ingredients is prepared:

| | Wt. % |
|---|---|
| Hard and soft dipalmitic acid quaternary ammonium compound | 2.67 |
| Amido amine (Cpd. #1) | 5.33 |
| Hydrochloric acid | 0.24 |
| Water | Balance to 100% |

The foregoing composition has a pH of from 2.3 to 4.0.

EXAMPLE II

Example I is repeated except that the ester quaternary ammonium compound is used at 2% level and the amido amine at a 4% level.

EXAMPLE III

The following composition is prepared:

| | Wt. % |
|---|---|
| Ester Quat Cpd. #I | 2.7 |
| Amido Amine Cpd. #I | 5.3 |
| Hydrochloric Acid | 0.2 |
| Preservative | 0.0001 |
| Color and perfume | 0.003 |
| Water | Balance to 100% |

This composition is used to treat clothes in the rinse cycle of a laundry machine. The clothes after drying exhibit excellent softening.

A distinct advantage of this formulation is its stability versus amido amine alone. Also, the combination gives better softening than amido amine alone or amido amine plus a conventional cationic such as ditallowdimethyl ammonium chloride.

We claim:

1. A fabric softening composition in the form of an aqueous dispersion containing from about 3% to about 60% by weight of fabric softeners composition consisting essentially of fatty acid ester containing quaternary ammonium softener salt having the formula

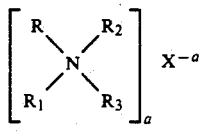

wherein R represents an aliphatic ester residue of from 12 to 30 carbon atoms of the formula

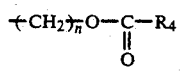

and n is a number of from 1 to 3, $[R^1]$ $R_1$ represents R or a lower aliphatic group, aralkyl group or hydroxyalkyl group, $R_2$ and $R_3$ independently represent lower aliphatic group, aralkyl group or hydroxyalkyl group, $X^-$ is an anion and a represents the ionic valence of the anion; and a fatty acid amido amine softener having the formula

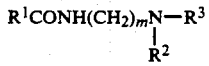

wherein $R^1$ is a C12 to C30 alkyl or alkenyl group, $R^2$ represents $R^1$, $R^1CONH(CH)_2)_m$ or $CH_2CH_2OH$; $R^3$ represents hydrogen, methyl, or $(CH_2CH_2O)_pH$, m is a number of from 1 to 5, and p is a number of from 1 to 5;

at a weight ratio of ester quaternary softener to fatty acid amido amine softener in the range of from about 10:1 to 1:10.

2. The composition of claim 1 wherein the weight ratio of ester quaternary softener to fatty amido amine softener ranges from about 5:1 to 1:5.

3. The composition of claim 1 wherein the weight ratio of ester quaternary softener to fatty amido amine softener ranges from about 3:1 to 1:3.

4. The composition of claim 1 wherein the weight ratio of ester quaternary softener to fatty amido amine softener is about 2:5.

5. The composition of claim 1 wherein the fatty acid ester is selected from the group consisting of $$C_{17}H_{35}COOCH_2-\underset{\underset{CH_3}{|}}{\overset{\overset{CH_3}{|}}{N^+}}-CH_2OOCC_{17}H_{35}X^-,$$

$$C_{17}H_{35}\overset{\overset{O}{\|}}{C}-OCH_2CH_2\overset{\overset{CH_3}{|}}{\underset{\underset{CH_3}{|}}{N^+}}CH_2CH_2O\overset{\overset{O}{\|}}{C}-C_{17}H_{35}X^-,$$

$$C_{17}H_{35}\overset{\overset{O}{\|}}{C}-OCH_2CH_2\overset{\overset{CH_2CH_2OH}{|}}{\underset{\underset{CH_2CH_2OH}{|}}{N^+}}-CH_2CH_2O\overset{\overset{O}{\|}}{C}-C_{17}H_{35}X^-, \text{ and}$$

$$C_{17}H_{35}\overset{\overset{O}{\|}}{C}-OCH_2\overset{\overset{CH_2CH_2OH}{|}}{\underset{\underset{CH_2CH_2OH}{|}}{N^+}}-CH_2-O-\overset{\overset{O}{\|}}{C}C_{17}H_{35}X^-.$$

6. The composition of claim 5 wherein the fatty amido amine softener is selected from the group consisting of $$C_{17}H_{35}CONHCH_2CH_2\underset{\underset{(CH_2CH_2O)_3H}{|}}{N}CH_2CH_2NHOCC_{17}H_{35},$$

-continued $$C_{17}H_{35}CONHCH_2CH_2\underset{\underset{(CH_2CH_2O)_2H}{|}}{N}CH_2CH_2NHO\overset{\overset{O}{\|}}{C}C_{17}H_{35},$$

$$C_{17}H_{35}CONHCH_2CH_2\underset{\underset{CH_2CH_2OH}{|}}{N}-CH_2CH_2NH\overset{\overset{O}{\|}}{C}C_{17}H_{35}.$$

7. The composition of claim 1 wherein the fatty amido amine softener is a compound selected from the group consisting of $$C_{17}H_{35}CONHCH_2CH_2\underset{\underset{(CH_2CH_2O)_3H}{|}}{N}CH_2CH_2NHOCC_{17}H_{35},$$

$$C_{17}H_{35}CONHCH_2CH_2\underset{\underset{(CH_2CH_2O)_2H}{|}}{N}CH_2CH_2NH\overset{\overset{O}{\|}}{C}C_{17}H_{35},$$

$$C_{17}H_{35}CONHCH_2CH_2\underset{\underset{CH_2CH_2OH}{|}}{N}-CH_2CH_2NH\overset{\overset{O}{\|}}{C}C_{17}H_{35}.$$

* * * * *